US010064491B2

(12) United States Patent
Piretti

(10) Patent No.: US 10,064,491 B2
(45) Date of Patent: Sep. 4, 2018

(54) FOLDING CHAIR

(71) Applicant: Pro-Cord S.p.A., Bologna (IT)

(72) Inventor: Giancarlo Piretti, Bologna (IT)

(73) Assignee: PRO-CORD S.P.A., Bologna (IT)

( * ) Notice: Subject to any disclaimer, the term of this patent is extended or adjusted under 35 U.S.C. 154(b) by 121 days.

(21) Appl. No.: 15/383,377

(22) Filed: Dec. 19, 2016

(65) Prior Publication Data

US 2017/0172304 A1 Jun. 22, 2017

(30) Foreign Application Priority Data

Dec. 22, 2015 (IT) ..... 10201586544

(51) Int. Cl.

| | |
|---|---|
| ***A47C 4/04*** | (2006.01) |
| ***A47C 4/14*** | (2006.01) |
| ***A47C 5/10*** | (2006.01) |
| ***A47C 7/16*** | (2006.01) |
| ***A47C 4/24*** | (2006.01) |

(52) U.S. Cl.

CPC ..... *A47C 4/04* (2013.01); *A47C 4/14* (2013.01); *A47C 4/24* (2013.01); *A47C 5/10* (2013.01); *A47C 7/16* (2013.01)

(58) Field of Classification Search

CPC .... A47C 4/00; A47C 4/04; A47C 4/14; A47C 4/24; A47C 4/28; A47C 4/38; A47C 4/48; A47C 5/10; A47C 7/16

USPC ..... 297/55, 56

See application file for complete search history.

(56) References Cited

U.S. PATENT DOCUMENTS 3,705,744 A 12/1972 Piretti et al.
4,441,757 A * 4/1984 Gasca Burges ..... A47C 5/10 108/115
5,524,966 A 6/1996 Piretti
(Continued)

FOREIGN PATENT DOCUMENTS

EP 0034452 A2 8/1981
EP 3095354 A1 * 11/2016 ..... A47C 4/04
(Continued)

OTHER PUBLICATIONS

Italian Search Report and Written Opinion dated Jun. 30, 2016 for Application No. ITUB20159640.

*Primary Examiner* — Ryan D Kwiecinski
(74) *Attorney, Agent, or Firm* — Patterson & Sheridan, LLP

(57) ABSTRACT

A folding chair comprising: a seat comprising a seat panel fixed to two seat supports, a backrest comprising a flexible backrest panel and two backrest supports having respective upper portions that engage respective side edges of said flexible backrest panel, a folding frame carrying the seat and the backrest and comprising a first structure including a pair of rear legs and a second structure including a pair of front legs, wherein the first structure and the second structure are articulated together about a first axis, a pair of joints each comprising a first half-coupling fixed to a respective rear leg and a second half-coupling fixed to a respective front leg, wherein the first half-coupling, the second half-coupling, and a respective seat support are rotatable relative to each other about said first axis, so that the first structure, the second structure and the seat are rotatable about said first axis between a position of use and a storage position.

6 Claims, 11 Drawing Sheets

(56) References Cited

U.S. PATENT DOCUMENTS

| | | | | |
|---|---|---|---|---|
| 6,742,839 | B2 * | 6/2004 | Piretti | A47C 3/04 297/239 |
| D648,554 | S * | 11/2011 | Smith | D6/368 |
| 2008/0284216 | A1 * | 11/2008 | Mayercheck | A47C 4/14 297/46 |
| 2010/0156156 | A1 * | 6/2010 | Smith | A47C 1/124 297/239 |
| 2016/0255960 | A1 * | 9/2016 | Piretti | A47C 5/06 |
| 2016/0338492 | A1 * | 11/2016 | Piretti | A47C 4/04 |

FOREIGN PATENT DOCUMENTS

| | | | |
|---|---|---|---|
| FR | 2170349 | A5 | 9/1973 |
| FR | 2507070 | A3 | 12/1982 |

* cited by examiner

FOLDING CHAIR

CROSS-REFERENCE TO RELATED APPLICATIONS

This application claims benefit of Italian patent application number 102015000086544, filed Dec. 22, 2015, which is herein incorporated by reference.

BACKGROUND OF THE INVENTION

Field of the Invention

The present invention relates to a folding chair comprising a seat, a backrest, and a folding frame carrying the seat and the backrest and movable between a position of use and a position of storage.

Description of Prior Art

U.S. Pat. No. 3,705,744 by the same inventor describes a folding chair in which the backrest is fixed to a first rectangular U-shaped frame defining the front legs and in which a second U-shaped frame defining the rear legs is articulated to the first frame about a transverse axis. The seat is articulated about the same transverse axis.

U.S. Pat. No. 5,524,966 by the same applicant describes a folding chair provided with three structures defining, respectively, the front legs, the rear legs and the seat, which are mutually articulated about a common transverse axis. The backrest of the chair forms part of a fourth structure separate from said three structures and articulated on one of them about the common axis.

Generally, folding chairs have a backrest with reduced dimensions. It would be desirable to increase the surface area of the backrest of the folding chairs to provide a greater comfort to the user. However, often it is not possible to increase the surface area of the backrest because with a backrest with greater dimensions, in the storage configuration, the backrest would be at least partially overlapped to the seat and this would increase the volume of the chair in the storage configuration.

SUMMARY OF THE INVENTION

The present invention aims to provide a folding chair with a backrest that offers higher characteristics of comfort to the user in the condition of use, and that has a minimum volume in the storage position.

According to the present invention, this object is achieved by a chair having the characteristics forming the subject of claim 1.

The claims form an integral part of the disclosure provided here in relation to the invention.

BRIEF DESCRIPTION OF THE DRAWINGS

The present invention will now be described in detail with reference to the attached drawings, given purely by way of non-limiting example, wherein.

DETAILED DESCRIPTION

Figure 1:
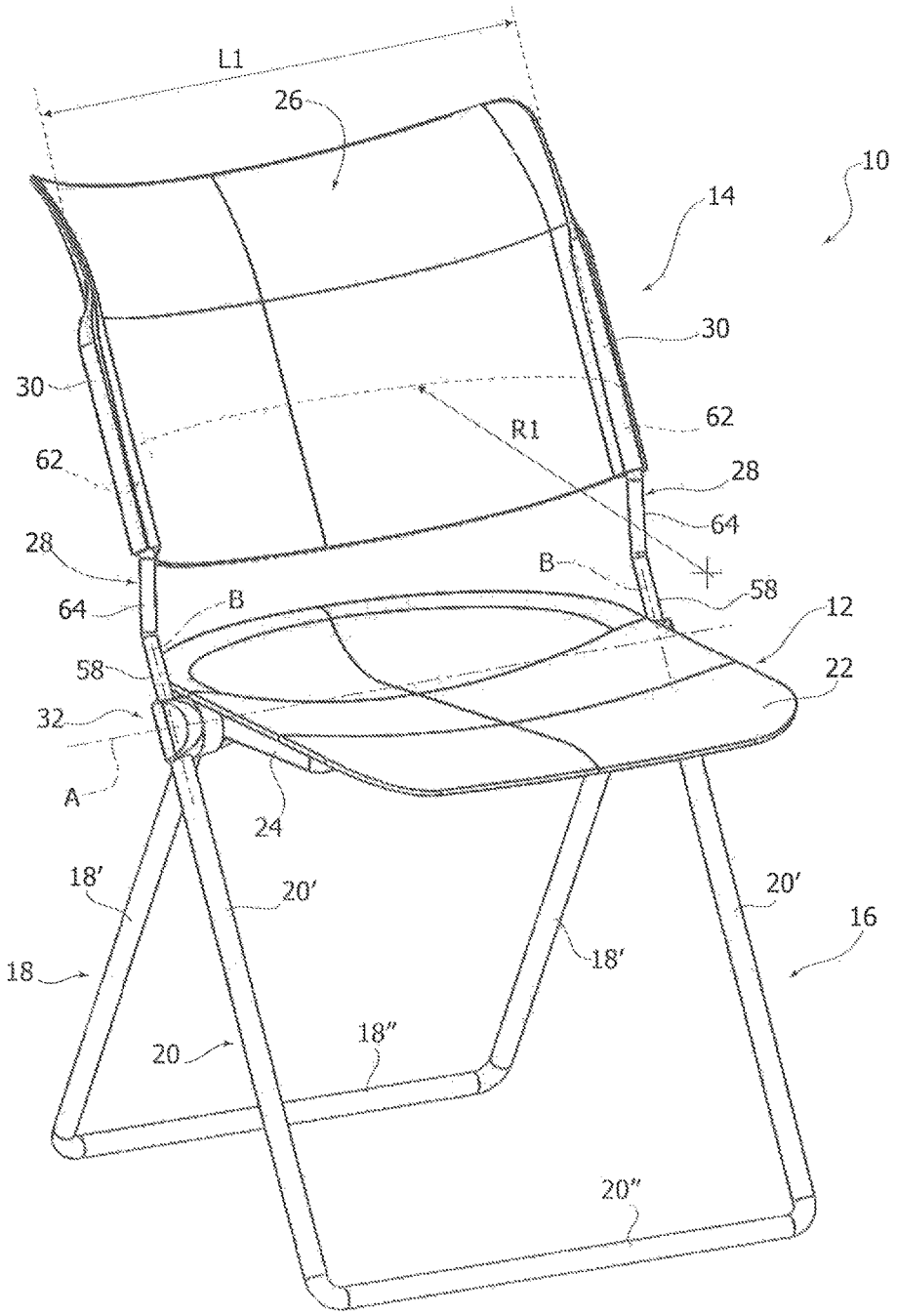
FIGS. 1 and 2 are perspective views of a folding chair according to the present invention in the position of use and in the storage position, respectively.
Figure 2:
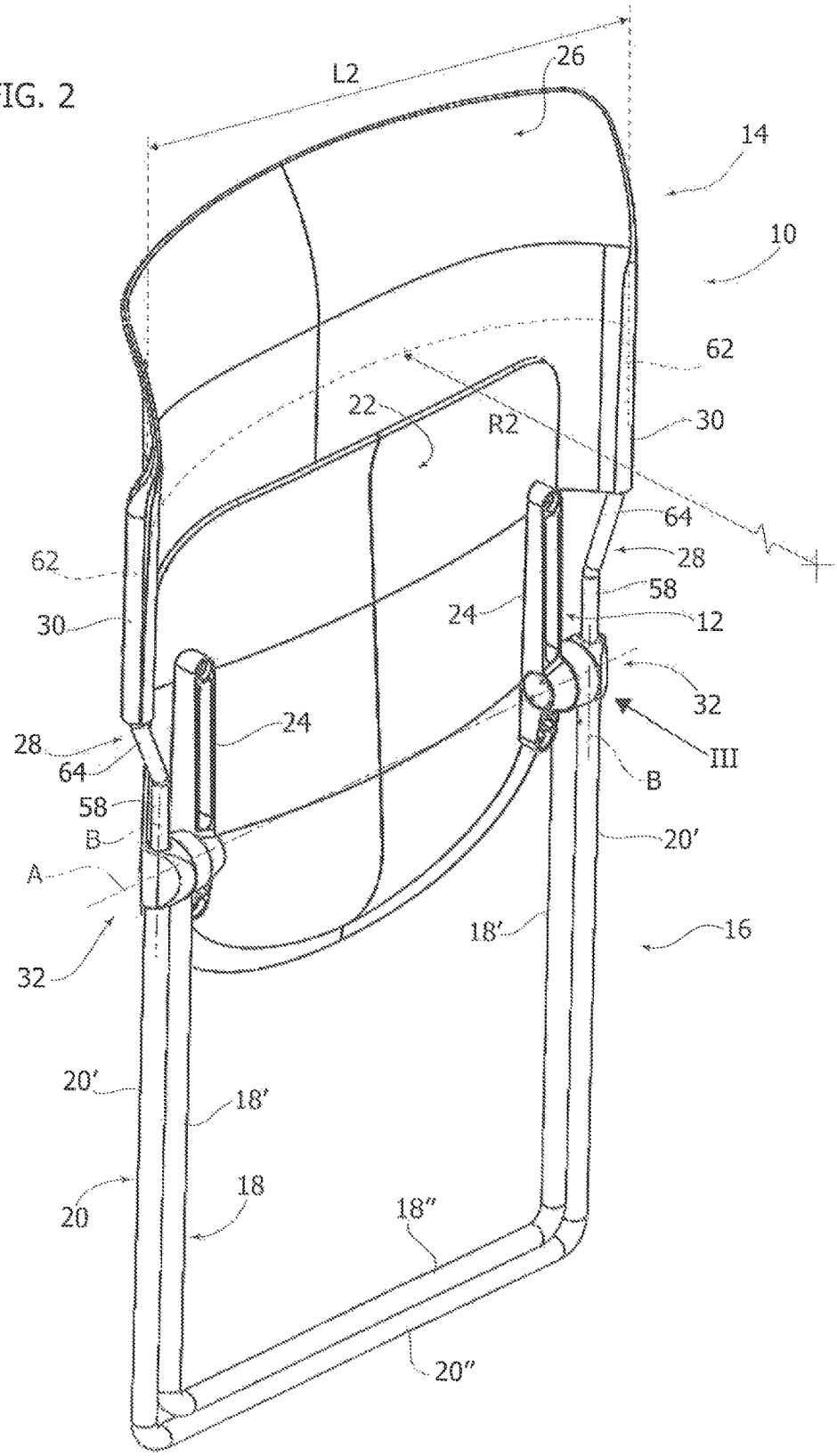

With reference to FIGS. 1 and 2, numeral 10 indicates a folding chair according to the present invention. The chair 10 comprises a seat 12, a backrest 14, and a folding frame 16 that carries the seat 12 and the backrest 14.

The folding frame 16 comprises a first structure 18 and a second structure 20 articulated to each other about a first axis A, transverse with respect to the longitudinal axis of the chair 10. The first and the second structure 18, 20 are formed of respective tubular U-shaped elements. The first structure 18 comprises a pair of rear legs 18' joined together at their lower ends by a rear transverse element 18". The second structure 20 comprises a pair of front legs 20' joined together at their lower ends by a front transverse element 20".

The seat 12 comprises a seat panel 22 of rigid plastic material and two seat supports 24 fixed on the lower face of the seat panel 22. The seat supports 24 are articulated to the first structure 18 and the second structure 20 about the first axis A.

The backrest 14 comprises a flexible backrest 26 and two backrest supports 28, which engage respective side edges 30 of the flexible backrest panel 26. Preferably, the flexible backrest panel 26 is made of elastically deformable plastic material, for example nylon. The flexible backrest panel 26 assumes an arched position of use and an extended storage position. In the position of use, the backrest panel 26 has a radius of curvature R1 substantially smaller than the radius of curvature R2 of the backrest panel 26 in the position of storage.

Figure 3:
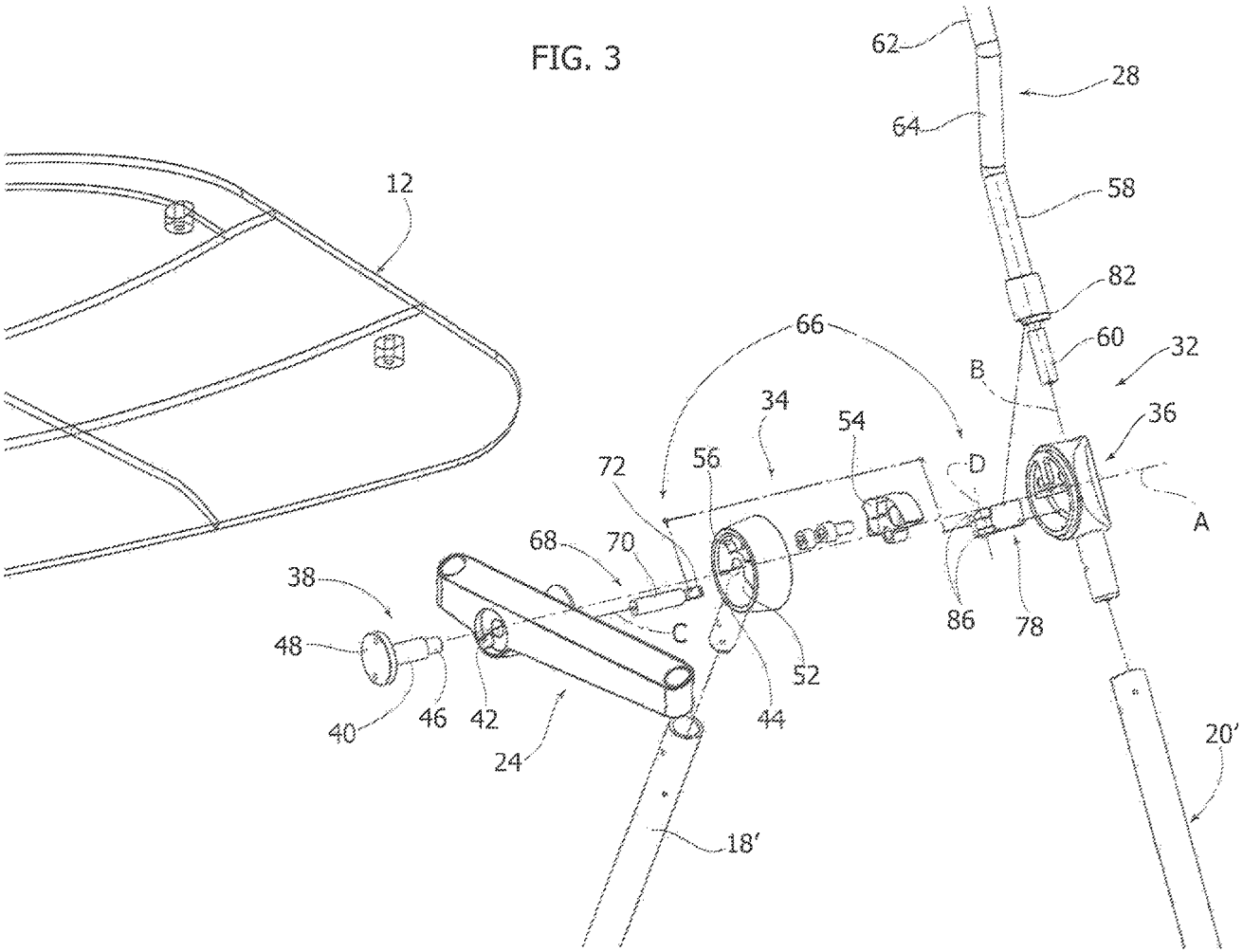
FIG. 3 is an exploded perspective view of the part indicated by the arrow III in FIG. 2.
Figure 4:
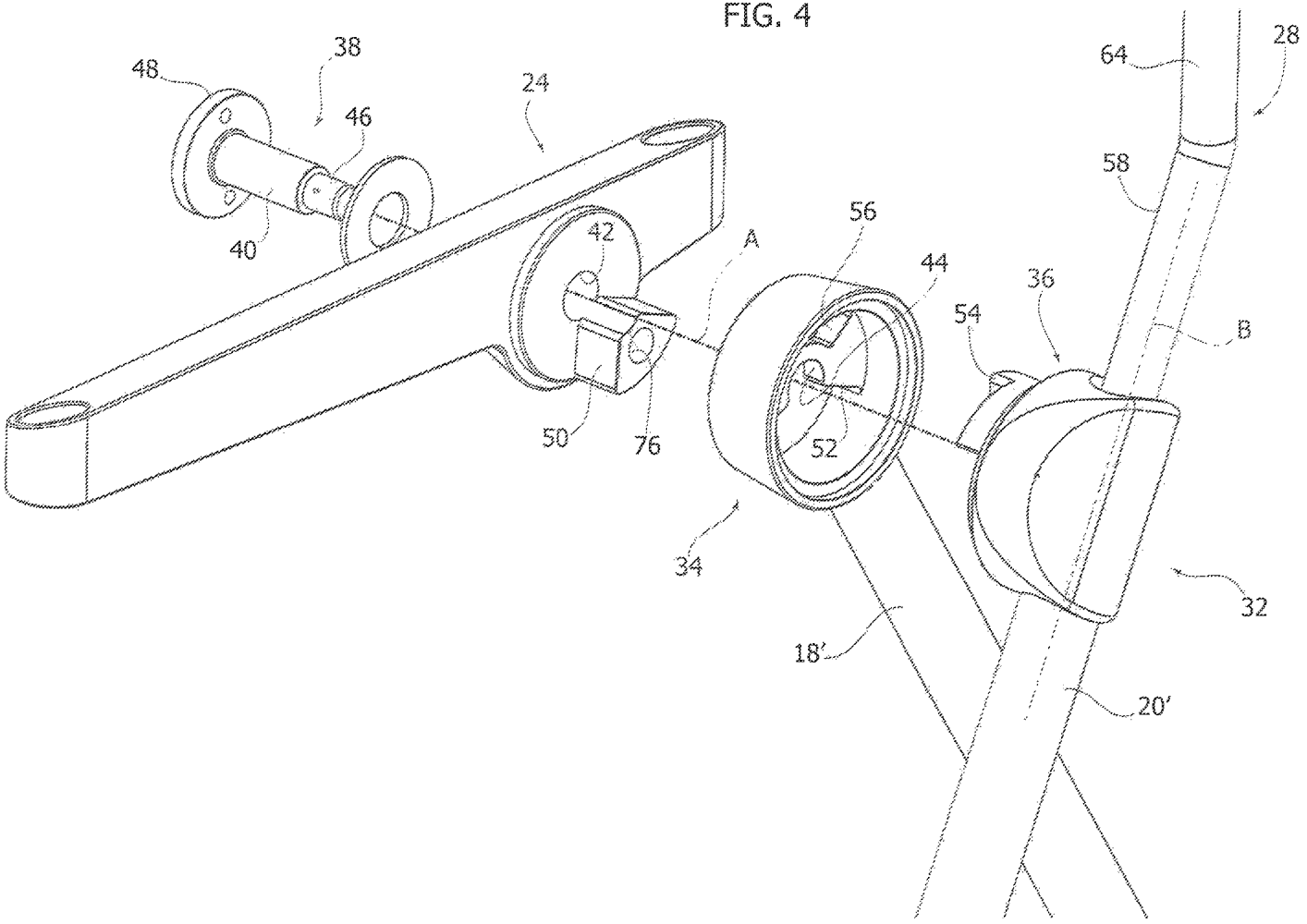
FIGS. 4 and 5 are exploded perspective views of some of the components of FIG. 3, with other components removed for greater clarity.

The chair 10 comprises a pair of joints 32, which articulate together the seat 12, the first structure 18 and the second structure 20 about the first axis A. With reference to FIGS. 3 and 4, each joint 32 comprises a first half-coupling 34 fixed to a respective rear leg 18' and a second half-coupling 36 fixed to a respective front leg 20'. The first half-coupling 34 is arranged in an intermediate position between the respective seat support 24 and the second half-coupling 36.

The seat support 24, the first half-coupling 34 and the second half-coupling 36 are articulated together about the first axis A by means of a pivot pin 38. The pivot pin 38 has an articulation portion 40, which rotatably engages central holes 42, 44 of the seat support 24 and of the first half-coupling 34, and an attachment portion 46, which is fixed to the second half-coupling 36. The pivot pin 38 also has a head 48, which constrains the seat support 24 and the first half-coupling 34 to the second half-coupling 36 in the axial direction.

With reference to FIG. 4, the seat support 24 has a first tooth 50, eccentric with respect to the axis A, which is inserted into a first window 52 of the first half-coupling 34. The second half-coupling 36 has a second tooth 54, eccentric with respect to the axis A, which is inserted into a second window 56 of the first half-coupling 34. The first window 52 and the second window 56 are shaped as circular sectors. The first tooth 50 and the second tooth 54 can be formed in an integral manner or fixed to the seat support 24 and, respectively, to the second half-coupling 36. The first tooth 50 cooperates with the opposite ends of the first window 52 for rotating the first half-coupling 34 and the rear leg 18' attached to it about the axis A, as a result of the movement of the seat 12 between the position of use and the storage position, and vice versa. The first tooth 50 and the first window 52 also define a stop for the seat 12 in the position of use. The second tooth 54 cooperates with the opposite ends of the second window 56 to define a stop between the first half-coupling 34 and the second half-coupling 36 in the position of use and in the storage position.

With reference to FIGS. 3 to 6, each backrest support 28 has a lower portion 58 that rotatably engages the respective second half-coupling 36 about a second axis B orthogonal to the first axis A. The lower portion 58 of the backrest support 28 is preferably provided with a pin-shaped appendage 60, which rotatably engages corresponding seats formed in the second half-coupling 36 to define the second axis B. Preferably, the pin-shaped appendage 60 is a separate component fixed to the lower portion 58, for example by threading. The lower portion 58 of the backrest support 28 is preferably aligned with and coaxial to the respective front leg 20'.

Each backrest support 28 has an upper portion 62 eccentric with respect to the second axis B. The upper portion 62 engages a respective side edge 30 of the flexible backrest panel 26. The upper portion 62 of the backrest support 28 is connected to the respective lower portion 58 by means of an inclined portion 64.

Figure 5:
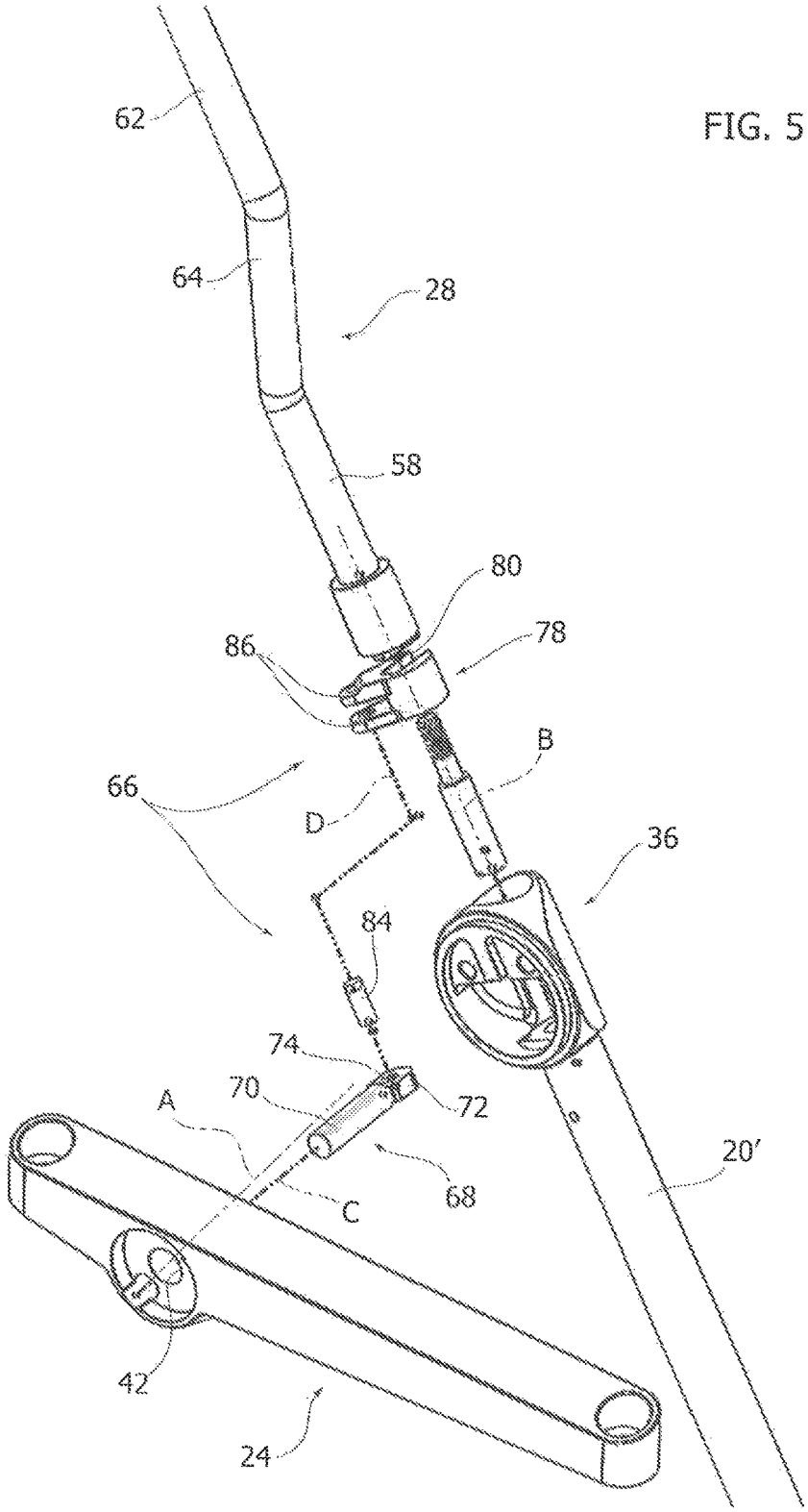
Figure 6:
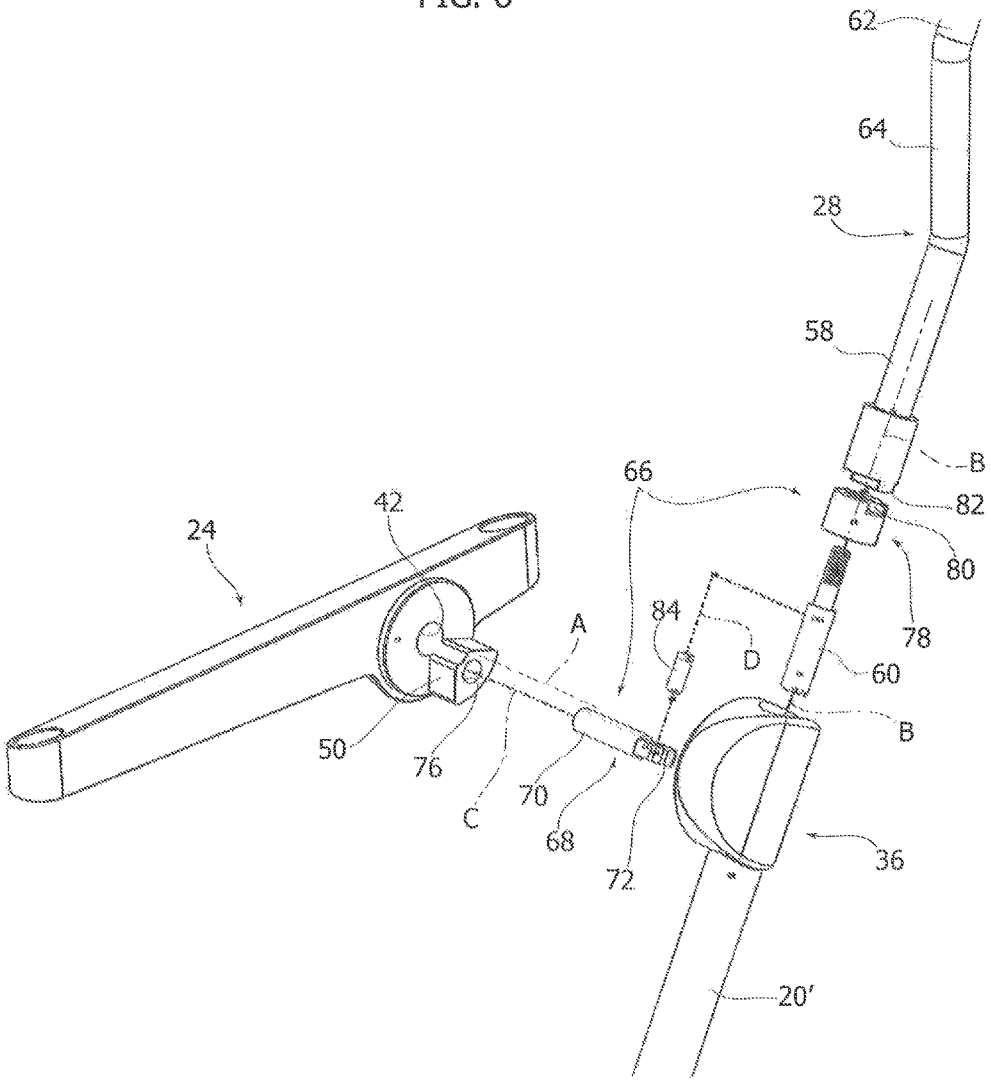
FIG. 6 is an exploded perspective view from a different angle, of the components of FIG. 5.

With reference to FIGS. 3, 5 and 6, each seat support 24 is connected to the respective backrest support 28 via a transmission mechanism 66 that controls the rotation of the backrest support 28 about the second axis B as a result of a rotation of the seat support 24 about the first axis A. In the embodiment illustrated in FIGS. 3-6, the transmission mechanism 66 comprises a pin 68 having a cylindrical shank 70 and a square head 72 having a transverse hole 74. The cylindrical shank 70 of the pin 68 engages a hole 76 of the seat support 24 having an axis C parallel and eccentric with respect to the first axis A. The pin 68 is free to rotate in the hole 76 about the axis C and is free to move with respect to the seat support 24 in the direction of the axis C.

The transmission mechanism 66 comprises a crank element 78 rotationally fixed relative to the backrest support 28 about the axis B. In the illustrated example, the rotationally fixed engagement between the crank element 78 and the backrest support 28 is obtained by means of a front groove 80 of the crank element 78, engaged by a front tooth 82 of the backrest support 28. The crank element 78 is free to move in the direction of the axis B with respect to the backrest support 28, while maintaining the rotational engagement with the backrest support 28. The crank element 78 and the pin 68 are articulated together about an axis D parallel to and eccentric with respect to the axis B. In the illustrated example, this articulation is obtained by means of a pivot pin 84, which engages the hole 74 of the head 72 and corresponding holes of a fork-shaped portion 86 of the crank element 78.

When the seat support 24 oscillates about the axis A, the pin 68 completes a rotation along a circular path with its center on the axis A, with a radius equal to the distance between the axes C and A. The rotation of the pin 68 about the axis A produces a rotation of the crank element 78 about the axis B. A 90° rotation of the seat support 24 about the axis A, corresponding to the movement of the seat 12 from the position of use to the storage position, produces a 90° rotation of the backrest support 28 about the axis B between the position of use illustrated in FIG. 1 and the storage position illustrated in FIG. 2.

FIGS. 7-10 illustrate a variant of the transmission mechanism 66, which controls the rotation of the respective backrest support 28 about the second axis B, as a result of a rotation of the seat support 24 about the first axis A. The elements corresponding to those previously described are indicated with the same numerical references.

In this variant, the transmission mechanism 66 is greatly simplified compared to the version illustrated in FIGS. 3-6. In this case, the transmission mechanism 66 comprises a lever 90, which is fixed to the lower portion 58 of the respective backrest support. The lever 90 is rotatable about the axis B in a seat 92 (FIG. 7) of the second half-coupling 36. The lever 90 has a spherical head 94, which engages a cavity 96 (FIGS. 9 and 11) of the first half-coupling 34.

The relative rotation of the first half-coupling 34 with respect to the second half-coupling 36 about the axis A produces a rotation of the lever 90 about the axis B due to the engagement between the cavity 96 of the first half-coupling 36 and the spherical head 90 of the lever 90. As in the case of the previously described variant, in this variant as well, a rotation of the seat support 24 about the axis A corresponding to the movement of the seat 12 from the position of use to the storage position, produces a 90° rotation of the backrest support 28 about the axis B between the position of use illustrated in FIG. 1 and the storage position illustrated in FIG. 2.

Figure 7:
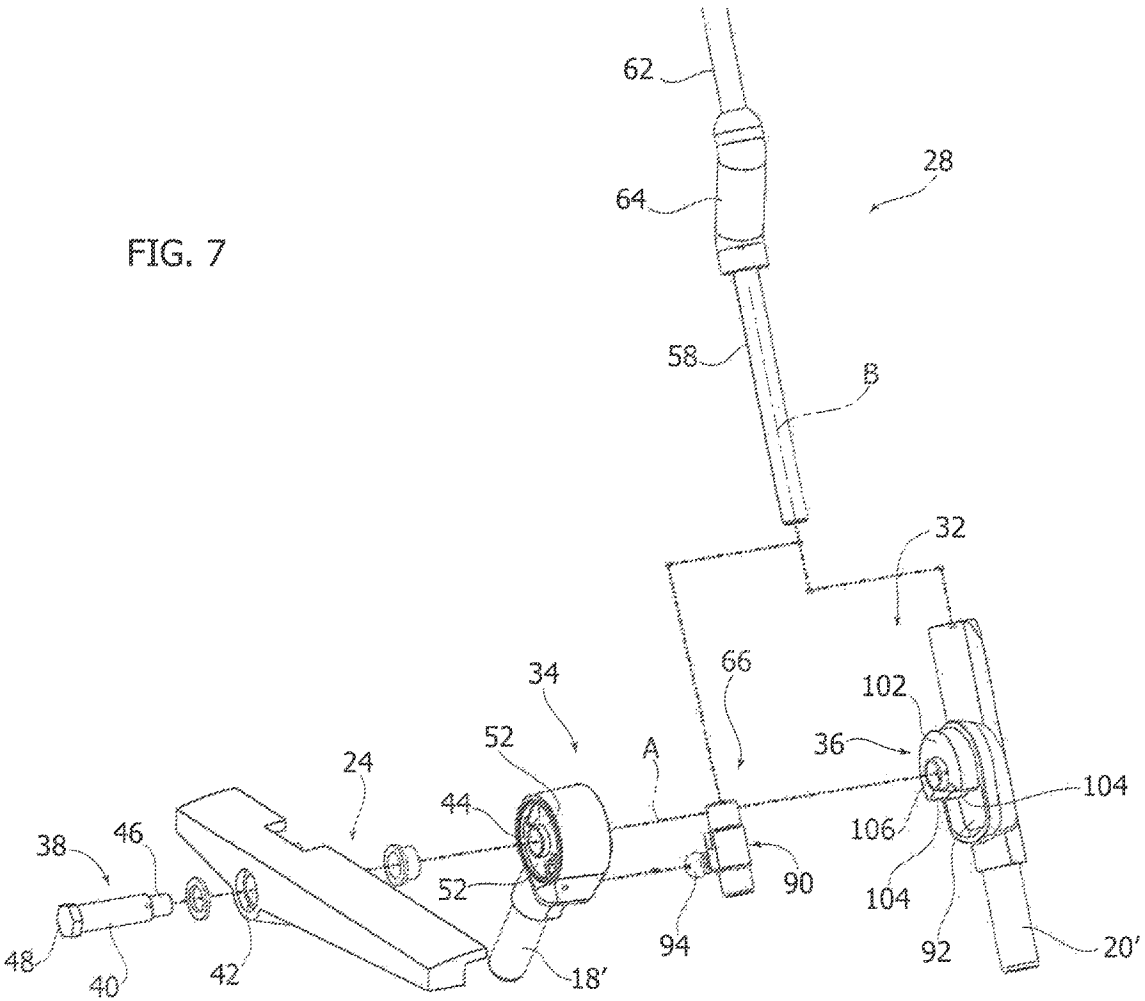
FIG. 7 is a exploded perspective view illustrating some components of a variant of the chair according to the present invention.
Figure 8:
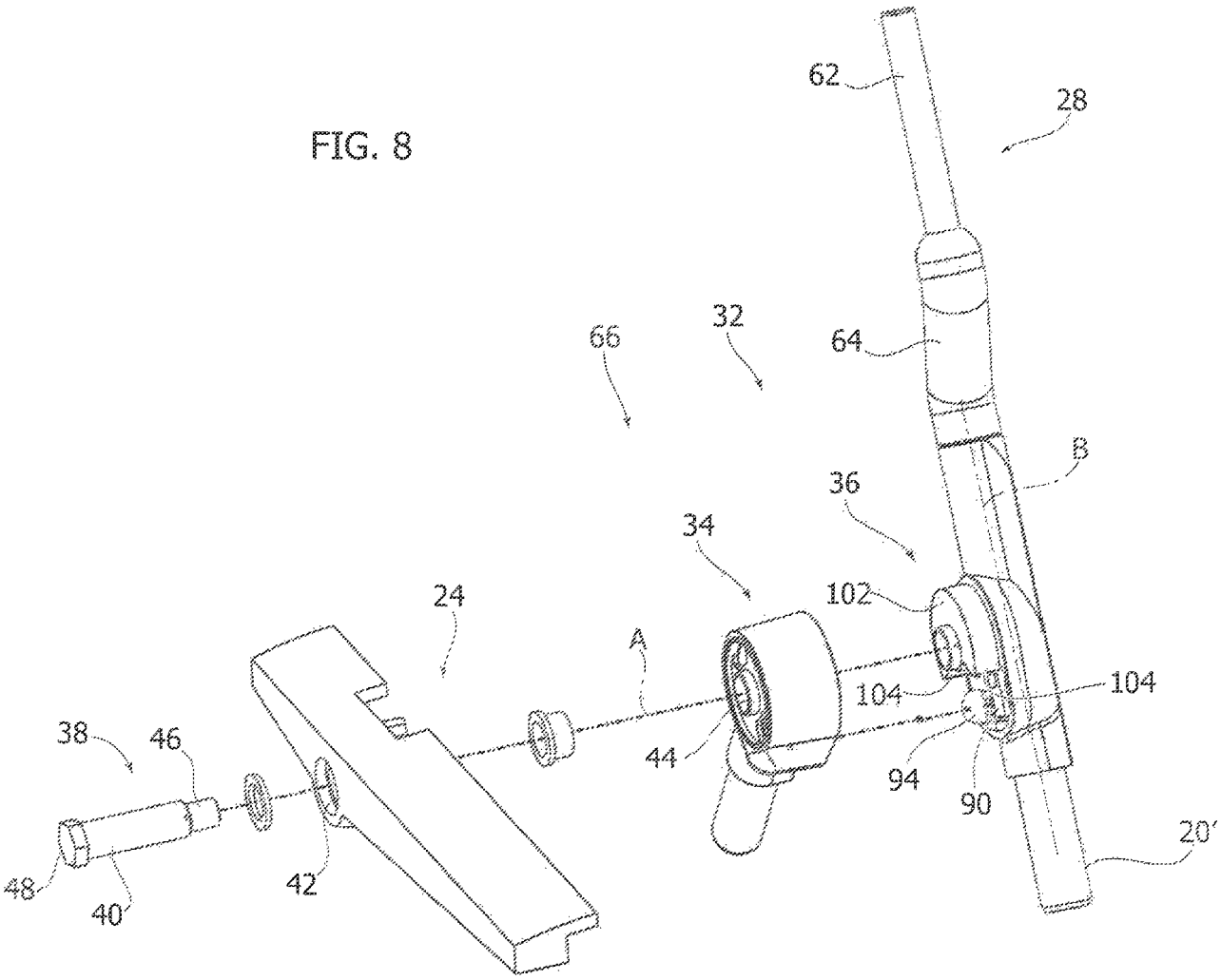
FIGS. 8 and 9 are exploded perspective views illustrating some components of the chair according to the variant of FIG. 7 in the position of use.
Figure 9:
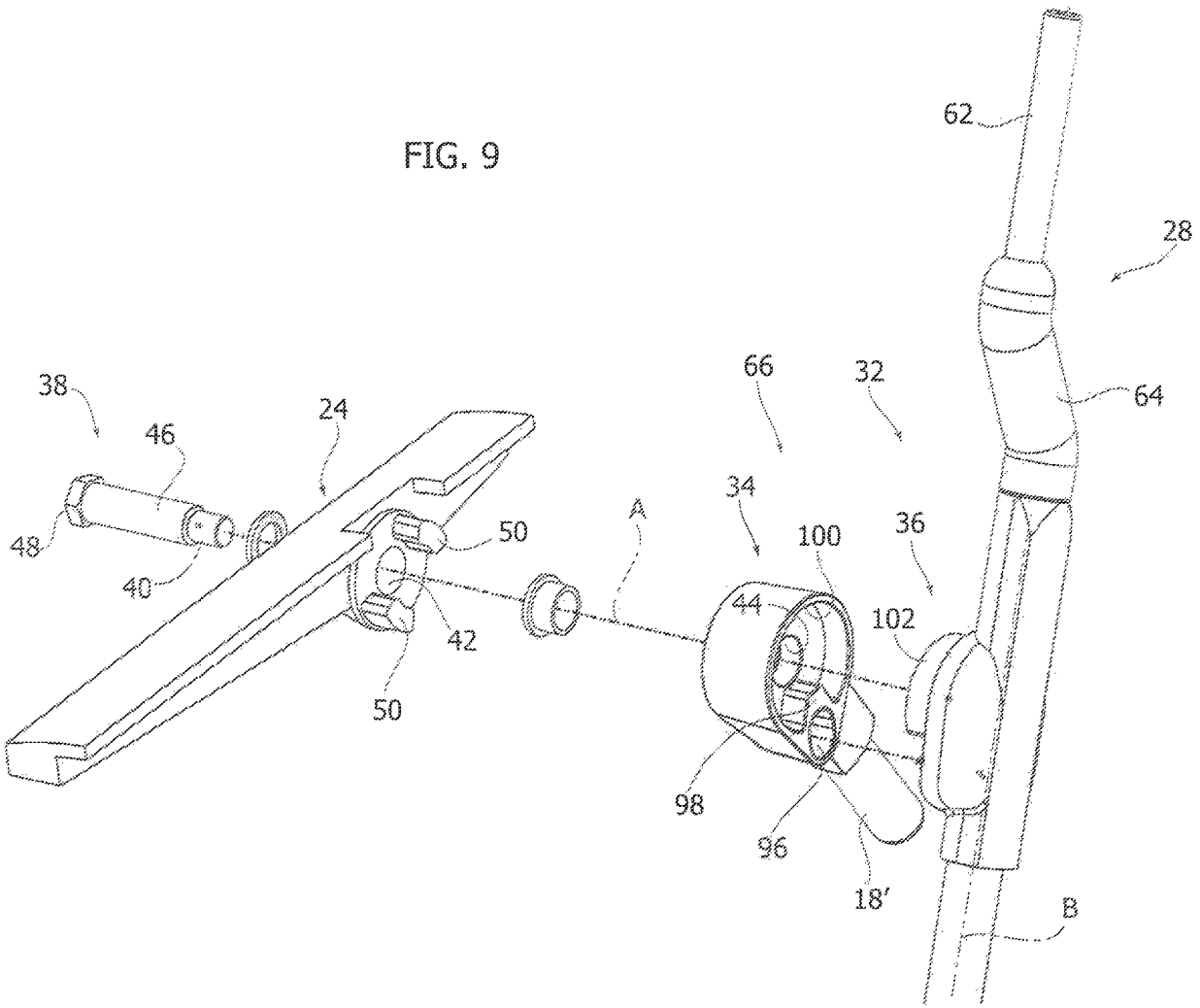
Figure 10:
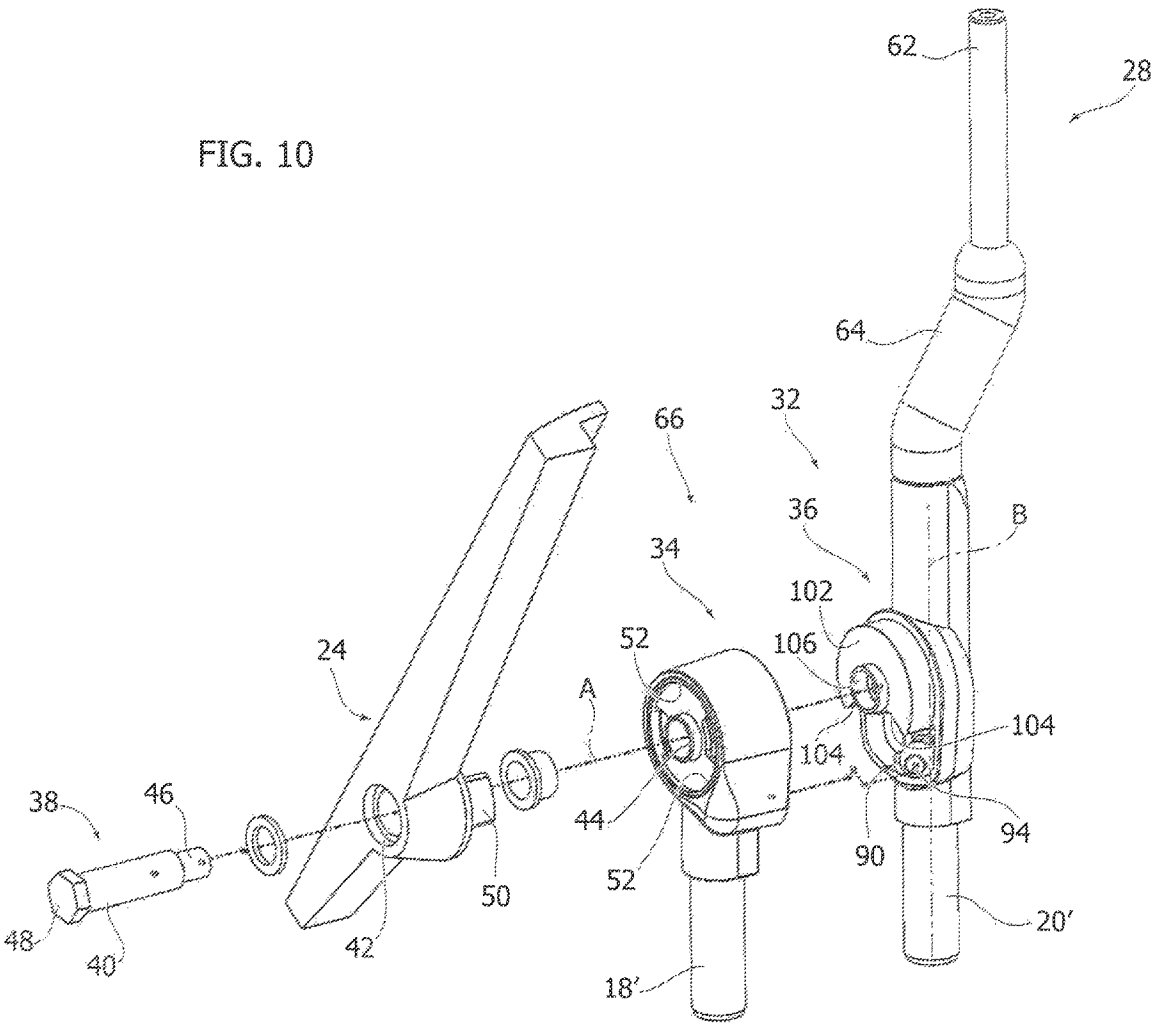
FIGS. 10 and 11 are exploded perspective views illustrating some components of the chair according to the variant of FIG. 7 in the position of storage.
Figure 11:
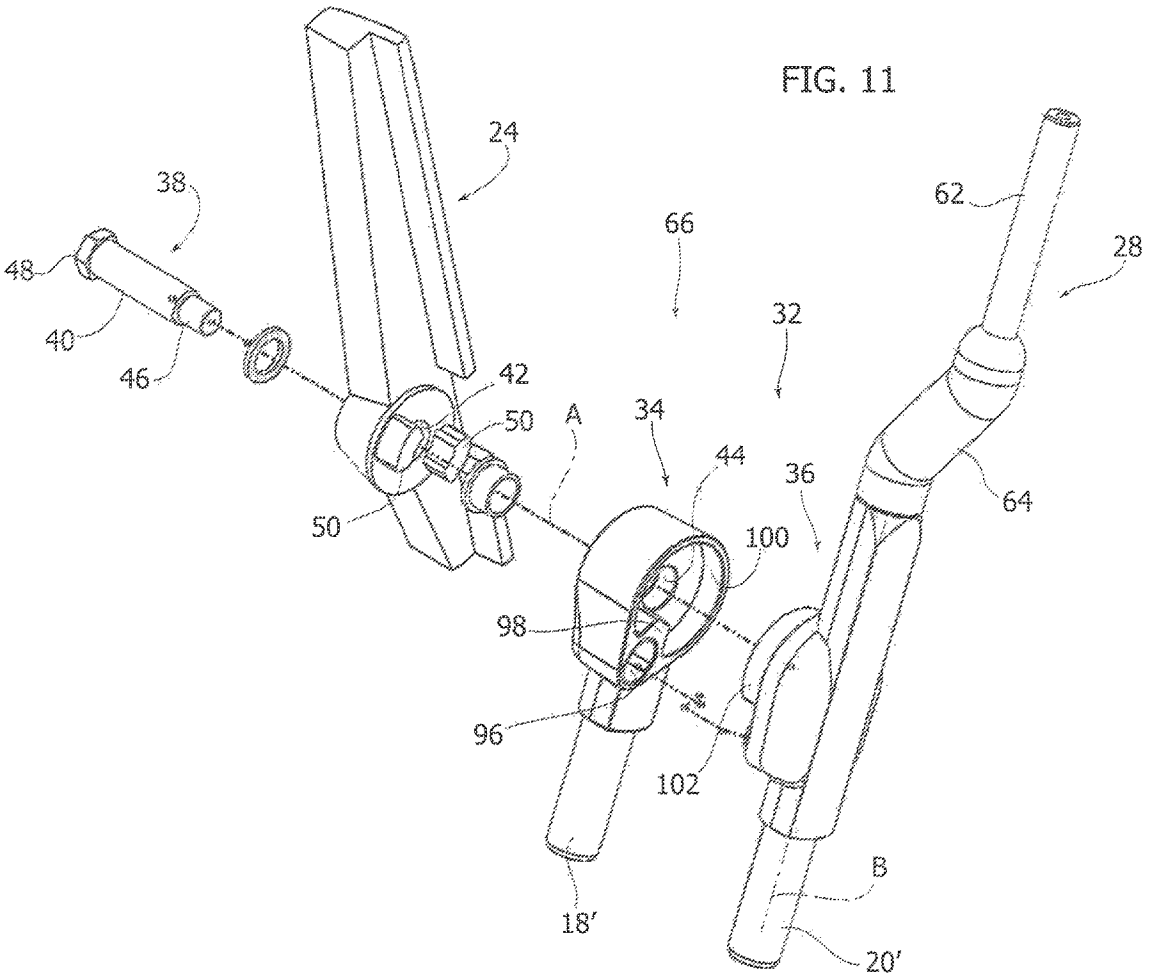

With reference to FIGS. 9 and 11, the seat support 24 has two first teeth 50, eccentric with respect to the axis A, which are inserted into respective windows 52 (FIGS. 7 and 10) of the first half-coupling 34. With reference to FIGS. 9 and 11, the second half-coupling 36 has a second tooth 96 projecting radially into a chamber 100. With reference to FIGS. 7, 8 and 10, the second half-coupling 36 has a projection 102, which is inserted into the chamber 100 of the first half-coupling 34. The projection 102 has two bearing surfaces, which cooperate with the second tooth 98 of the first half-coupling 34.

As in the previously-described embodiment, the first teeth 50 cooperate with the opposite ends of the first windows 52 for rotating the first half-coupling 34—and the rear leg 18' attached to it—about the axis A, as a result of the movement of the seat 12 between the position of use and the storage position, and vice versa. The first teeth 50 and the first windows 52 also define a stop for the seat 12 in the position of use. The second tooth 54 cooperates with the bearing surfaces 104 of the projection 102 of the second half-coupling 36 to define a stop between the first half-coupling 34 and the second half-coupling 36 in the position of use and in the storage position.

The projection 102 of the second half-coupling 36 has an axial hole 106 within which the attachment portion 46 of the pivot pin 38 is fixed.

In both embodiments, in the position of use, the upper portions 62 of the backrest supports 28 are at a minimum relative distance, indicated by L1 in FIG. 1. In this position, the flexible backrest panel 26 assumes an arched position with a minimum radius of curvature R1. When the chair 10 is in the storage position illustrated in FIG. 2, the upper portions 62 of the backrest supports 28 are at the maximum relative distance, indicated with L2. The relative moving apart of the upper portions 62 of the backrest supports 28 causes the backrest panel 26 to assume an extended position with a radius of curvature R2 greater than the radius of curvature R1 of the position of use.

Therefore, during the passage from the position of use to the storage position, the flexible backrest panel 26 passes from an arched configuration with a low radius of curvature R1 that provides an optimal comfort condition for the user, to an extended position with a high radius of curvature R2, which minimizes the volume of the chair in the storage position.

Of course, without prejudice to the principle of the invention, the details of construction and the embodiments can be widely varied with respect to those described and illustrated, without thereby departing from the scope of the invention as defined by the claims that follow.

The invention claimed is:

1. A folding chair comprising:

a seat comprising a seat panel fixed to two seat supports;

a backrest comprising a flexible backrest panel and two backrest supports having respective upper portions that engage respective side edges of said flexible backrest panel;

a folding frame carrying the seat and the backrest and comprising a first structure including a pair of rear legs and a second structure including a pair of front legs, wherein the first structure and the second structure are articulated together about a first axis; and a pair of joints each comprising a first half-coupling fixed to a respective rear leg and a second half-coupling fixed to a respective front leg;

wherein the first half-coupling, the second half-coupling, and a respective seat support are rotatable relative to each other about said first axis, so that the first structure, the second structure and the seat are rotatable about said first axis between a position of use and a storage position; and wherein each of said backrest supports has a lower portion, which rotatably engages the respective second half-coupling about a second axis perpendicular to said first axis, wherein said upper portion of each of said backrest supports is eccentric with respect to said second axis, and wherein each seat support is connected to the respective backrest support via a transmission mechanism that controls the rotation of the respective backrest support about said second axis following a rotation of the seat support about the first axis, in such a way that the distance between the upper portions of the backrest supports has a minimum value in the position of use and a maximum value in the storage position.

2. A chair according to claim 1, wherein said transmission mechanism comprises a pin, which rotatably engages—in an axially movable manner—a hole of said seat support and eccentric with respect to said first axis, said pin being articulated to a crank element integral in rotation with the respective backrest support.

3. A chair according to claim 2, wherein said pin and said crank element are articulated together by means of an articulation pin parallel to and eccentric with respect to said second axis.

4. A chair according to claim 1, wherein said transmission mechanism comprises a lever fixed to the lower portion of the respective backrest support and having a spherical head, which engages a cavity of the first half-coupling.

5. A chair according to claim 1, wherein each of said seat supports comprises at least one first eccentric tooth, which engages a respective window of the first half-coupling.

6. A chair according to claim 1, wherein the first and the second half-coupling comprise a stroke-end device including at least one tooth fixed with respect to one of said half-couplings, and cooperating with stop surfaces fixed with respect to the other of said half-couplings.

* * * * *